US007226146B2

(12) United States Patent
Chen et al.

(10) Patent No.: US 7,226,146 B2
(45) Date of Patent: Jun. 5, 2007

(54) FLUID EJECTION DEVICES AND METHODS FOR FORMING SUCH DEVICES

(75) Inventors: Jingkuang Chen, Rochester, NY (US); Nancy Y Jia, Webster, NY (US); Pinyen Lin, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 254 days.

(21) Appl. No.: 10/999,210

(22) Filed: Nov. 30, 2004

(65) Prior Publication Data

US 2006/0114291 A1 Jun. 1, 2006

(51) Int. Cl.
*B41J 2/04* (2006.01)

(52) U.S. Cl. ..... 347/54; 347/63

(58) Field of Classification Search ..... 347/20, 347/44, 47, 54–56, 61–65, 67, 68, 70, 71
See application file for complete search history.

(56) References Cited

U.S. PATENT DOCUMENTS 6,332,669 B1 * 12/2001 Kato et al. ..... 347/54
6,572,218 B2 * 6/2003 Gulvin et al. ..... 347/54
6,662,448 B2 * 12/2003 Kubby et al. ..... 347/20

* cited by examiner

*Primary Examiner*—Juanita D. Stephens
(74) *Attorney, Agent, or Firm*—Oliff & Berridge, PLC

(57) ABSTRACT

Fluid ejection devices include a substrate having a cavity, a counter electrode formed on the substrate, a actuator membrane formed on the substrate, a roof layer formed on the substrate and a nozzle formed in the roof layer. Methods for forming fluid ejection devices include forming a cavity in a substrate, forming a counter electrode on the substrate, forming a actuator membrane on the substrate, forming a roof layer on the substrate and forming a nozzle in the roof layer.

19 Claims, 10 Drawing Sheets

FLUID EJECTION DEVICES AND METHODS FOR FORMING SUCH DEVICES

BACKGROUND OF THE INVENTION

1. Field of Invention

This invention is directed to fluid ejection devices and methods for forming fluid ejection devices.

2. Description of Related Art

Various mechanisms are known for practicing inkjet printing. Mass production of inkjet printheads, however, can be quite complicated and expensive. For example, according to some techniques, it is necessary to manufacture an orifice plate or nozzle plate separately from an ink supply and ink ejection actuator, and to later bond the plate to the device substrate. Employing such separate material processing steps to manufacture precision devices often adds significantly to the expense of production.

Side shooting inkjet technologies are employed in some applications, but again, manufacture of side shooting inkjet printheads is sufficiently inefficient as to make mass production undesirable. More esoteric manufacturing techniques have also been employed. For example, inkjet aperture plates can be formed by electroforming, wafer bonding, laser ablation and micro-punching, etc. Such techniques, however, also add substantial expense to the mass production of inkjet printheads and therefore increase consumer costs.

For high-quality inkjet printheads, it is necessary or desirable to have high nozzle density. Further, it is desirable that construction of the printheads be performed as simply as possible. One important strategy for simplifying construction and for increasing nozzle density is to limit the number of steps in construction and reduce the amount of misalignment between the device substrate and the aperture plate. Accordingly, it is desirable to monolithically form an ink chamber from a wafer instead of bonding a nozzle plate to a die to reduce cost and obtain high yields in production.

Where an inkjet printhead is of a mechanical type including many actuator devices, it is important to ensure that a substantial clearance is provided between an ink ejector nozzle plate and the surface of the actuator device. Unless a clearance on the order of 10-100 microns is provided, a number of problems may arise. For example, if the actuator membrane and the ink aperture plate are too close, an insufficient amount of ink flows into the ink chamber during an allowed ink refill period, and can result in ink starvation during operation. Ink starvation can result in missing droplets and/or insufficient droplet volume. Reducing jetting frequency and providing a longer ink refill period could improve performance, but such tactics are undesirable in view of their adverse impact on efforts to optimize operation speed and print quality.

The rapid advance of inkjet printing technology has changed the nature of the consumer printer market and has had significant impact on related areas of image/text production and microfluids manipulation. One of the forces that has driven the success of inkjet printers in the consumer market is the affordable cost of such devices and systems.

Of the manufacturing techniques for fabricating ink chambers including aperture plates, the most popular current approaches include wafer bonding, electro-forming and laser ablation of polymers. None of these approaches are wafer-level monolithic approaches. In view of the complexity and expense of such techniques, much effort has been expended on the development of monolithic approaches to inkjet printhead fabrication. Such efforts have focused on improving printing quality while reducing printhead cost.

SUMMARY OF THE INVENTION

The present invention is directed to a monolithic (e.g., polysilicon) fluid ejection device for inkjet printing. One of the barriers preventing known monolithic surface micromachining processes from being used to form printheads is the fact that sacrificial oxides deposited in such processes are too thin to allow for formation of a suitable fluidic channel. As discussed above, in microfluidic applications such as inkjet printing, a chamber height of at least 10 microns is required. Use of smaller chambers can result in ink starvation. Generally, sacrificial oxides cannot be formed to thicknesses of 10 microns or more.

The present inventors have discovered that it is possible to form fluid ejection devices by a monolithic process wherein the devices can be formed with channel heights of at least 10 microns. That is, the present inventors have discovered that fluid ejection devices can be formed by creating a trench in the silicon substrate and performing sequential layer formation using both a first sacrificial layer, such as a sacrificial oxide, and a second sacrificial layer, such as a spin-on-glass oxide. Sacrificial layers employed in the methods according to this invention can be formed to thicknesses in excess of 10 microns. As a result, the fluid ejection devices according to this invention can be formed by a monolithic process and include fluid channels and cavities at least 10 microns in depth.

In various exemplary embodiments, fluid ejection devices are provided. In other exemplary embodiments, methods for forming fluid ejection devices are provided. In still further exemplary embodiments, printing or image forming devices including fluid ejection devices according to this invention.

In various exemplary embodiments, fluid ejection devices according to this invention include a substrate having a cavity, a dielectric layer or multiple dielectric layers on the substrate, a counter electrode formed on the substrate, a actuator membrane formed on the substrate, a roof layer formed on the substrate and a nozzle formed in the roof layer. In various exemplary embodiments of fluid ejection devices according to this invention, the counter electrode is situated at least in part in the cavity. In various exemplary embodiments of the fluid ejection devices according to this invention, the actuator membrane is situated so as to substantially encapsulate the counter electrode. In various exemplary embodiments of the fluid ejection devices according to this invention, the roof layer is situated so as to cover the cavity.

In various exemplary embodiments, methods for forming fluid ejection devices according to this invention include forming a cavity in a substrate, forming a counter electrode on the substrate, forming a actuator membrane on the substrate, forming a roof layer on the substrate and forming a nozzle in the roof layer. In various exemplary embodiments of methods for forming fluid ejection devices according to this invention, at least a portion of the counter electrode is formed in the cavity. In various exemplary embodiments of methods for forming fluid ejection devices according to this invention, the actuator membrane is formed so as to encapsulate the counter electrode. In various exemplary embodiments of methods for forming fluid ejection devices according to this invention, the roof layer is formed so as to cover the cavity.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein:

FIG. 2(*b*) is a top view of an exemplary fluid ejection device according to this invention;

FIG. 3(*b*) is a cross-section of an exemplary fluid ejection device according to this invention;

FIG. 4(*b*) is a cross-section of an exemplary fluid ejection device according to this invention;

FIG. 5(*b*) is a cross-section of an exemplary fluid ejection device according to this invention;

FIG. 5(*c*) is a cross-section of the microchannel section of an exemplary fluid ejection device according to this invention;

DETAILED DESCRIPTION OF PREFERRED EMBODIMENTS

The following descriptions of various exemplary embodiments of the fluid ejection devices according to this invention employ structural configurations that are usable in fluid ejection systems and/or other technologies that store and consume fluids (e.g., fuel cells, assays of biomaterials). As applied herein, fluids refer to non-vapor (i.e., relatively incompressible) flowable media, such as liquids, slurries and gels. It should be appreciated that the principles of this invention, as outlined and/or discussed below, can be similarly applied to any known or later-developed fluid ejection systems. The fluid ejection devices described herein are particularly useful in inkjet printing.

Figure 1:
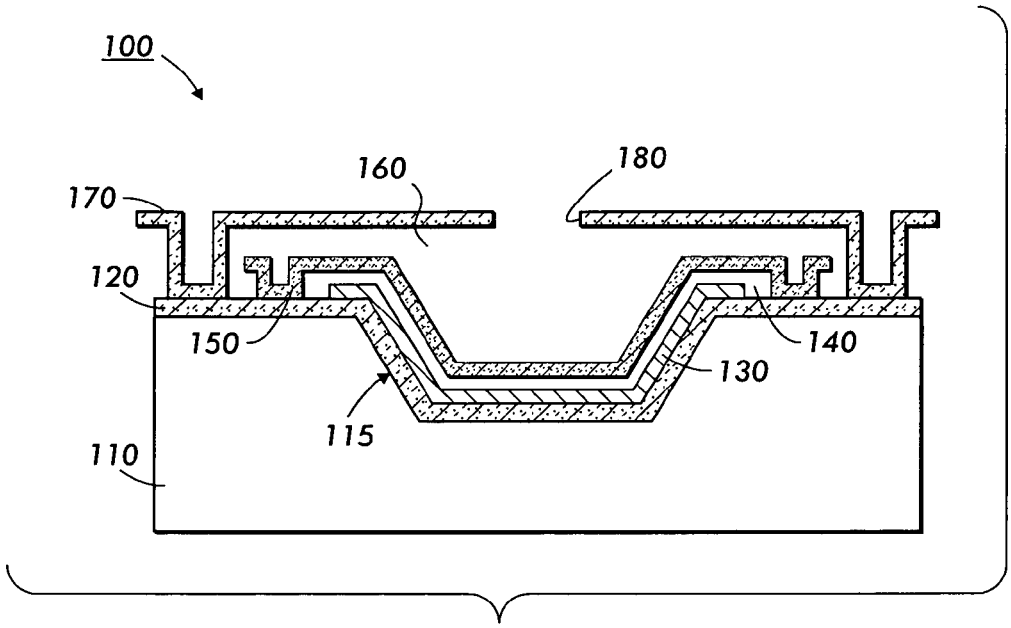
FIG. 1 is a cross-section view of an exemplary fluid ejection device according to this invention.

FIG. 1 is a cross-section view of an exemplary fluid ejection device according to this invention. The exemplary fluid ejection device 100 shown in FIG. 1 includes a substrate 110 having a cavity 115, a dielectric layer 120, a counter electrode 130, an actuator cavity 140, a actuator membrane 150, a fluid cavity 160, a roof layer 170 and a nozzle 180.

The substrate 110 can be any material suitable for formation of the various structures described herein. In various exemplary embodiments, the substrate 110 is a silicon substrate. A cavity 115 can be formed in the substrate 110. The cavity 115 can be formed in any shape or size suitable for accommodating a fluid to be ejected and the various structures necessary to accomplish such ejection. In various exemplary embodiments, the cavity 115 is from about 10 to about 100 microns in depth. A dielectric layer 120 (or multiple dielectric layers) can be formed over a surface of the substrate 110, including that surface forming the cavity 115.

Fluid ejection can be effected by a counter electrode 130, a actuator membrane 150 and an actuator cavity 140 situated between the counter electrode 130 and the actuator membrane 150. The counter electrode 130 can be formed on the substrate 110 over one or more surfaces of the cavity 115. The actuator membrane 150 can be formed over the counter electrode 130 such that an actuator cavity 140 is left between the counter electrode 130 and the actuator membrane 150. When voltage is applied to counter electrode 130, the actuator membrane 150 is drawn toward the counter electrode 130, increasing the volume of the cavity 140 below the actuator membrane 150. When the voltage is removed from the counter electrode 130 (the counter electrode 130 is grounded), the actuator membrane 150 is released. The release of the actuator membrane 150 decreases the volume of the cavity 140 below the actuator membrane 150.

A roof layer 170 can be formed on the substrate 110 over the cavity 115 and the counter electrode 130, actuator cavity 140 and actuator membrane 150 formed on the substrate 110. The roof layer 170 can be formed on the substrate 110 such that a fluid cavity 160 remains situated between the roof layer 170 and the counter electrode 130, actuator cavity 140 and actuator membrane 150 formed on the substrate 110. During operation, a fluid that will be ejected from the fluid ejection device 100 is situated in the fluid cavity 160. The roof layer 170 includes a nozzle 180. The nozzle 180 is an opening in the roof layer 170. The nozzle 180 can be formed in any shape or size suitable for ejection of a fluid.

When voltage is removed from the counter electrode 130, as discussed above, the actuator membrane 150 is released. The release of the actuator membrane 150 decreases the volume of the fluid cavity 160, causing an amount of fluid in the fluid cavity 160 to be ejected from the fluid ejection device 100 through the nozzle 180. After the amount of fluid is ejected, additional fluid is drawn into the fluid cavity 160 from an adjoining reservoir (not shown), and the operation can be repeated.

It should be appreciated that, while the embodiments described herein emphasize microelectromechanical system (MEMS) fluidic ejectors and methods for manufacturing such systems, the present inventors have specifically contemplated monolithically integrating high-voltage control electronics in/on the ejectors discussed herein. Moreover, the fluid injection devices according to this invention may be integrated into printing or image forming devices.

Figure 2A:
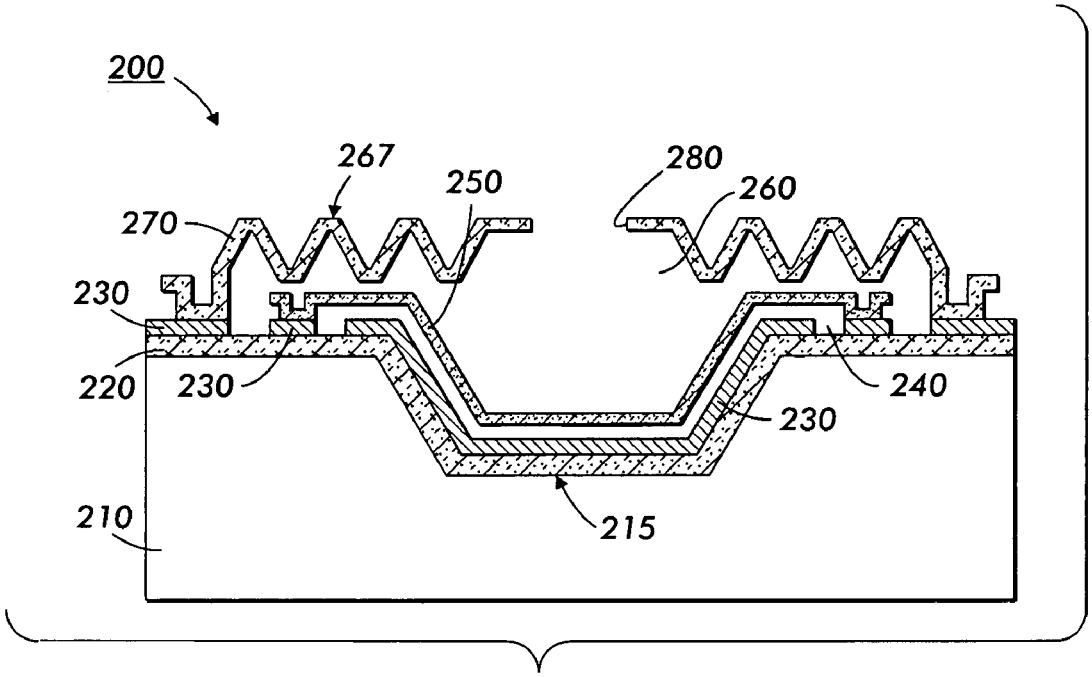
FIG. 2(*a*) is a cross-section view of an exemplary fluid ejection device according to this invention.
Figure 2B:
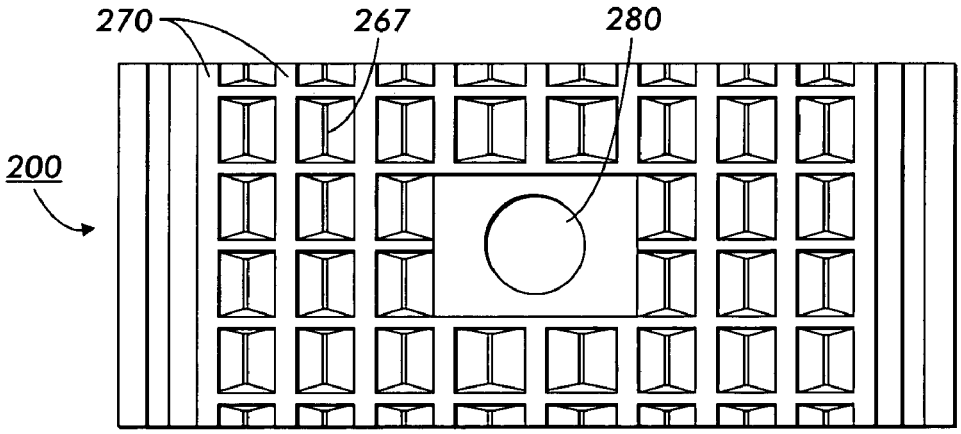

FIG. 2(*a*) is a cross-section view of an exemplary fluid ejection device according to this invention, and FIG. 2(*b*) is a top view of that device. The exemplary fluid ejection device 200 shown in FIGS. 2(*a*) and 2(*b*) includes a substrate 210 having a cavity 215, a dielectric layer 220, a counter electrode 230, an actuator cavity 240, a actuator membrane 250, a fluid cavity 260, a corrugated roof layer 270 including corrugation features 267 and a nozzle 280. FIG. 1 shows a fluid ejection device 100 with a generally planar roof layer 170. The fluid ejection device 200 of FIGS. 2(*a*) and 2(*b*), by contrast, includes a corrugated roof layer 270.

The roof layer 270 includes corrugation features 267. The corrugation features 267 can be any three dimensional features that enhance the mechanical strength of the roof layer 270. When the roof layer 270 is formed with corrugation features 267, which provide additional mechanical strength to the roof layer 270, the roof layer 270 can structurally bear the increased pressures caused by operation of the fluid ejection device 200, while being formed to smaller thicknesses than would be possible with a generally planar roof layer. As can be seen in FIGS. 2(*a*) and 2(*b*), the roof layer 270 is formed with corrugation features 267 that result in a roof layer 270 having a topography including multiple rectangular peaks. The shape and organization of the corrugation features 267 are not particularly limited, and can be provided in any manner that provides improved mechanical strength to the roof layer 270.

Figure 3A:
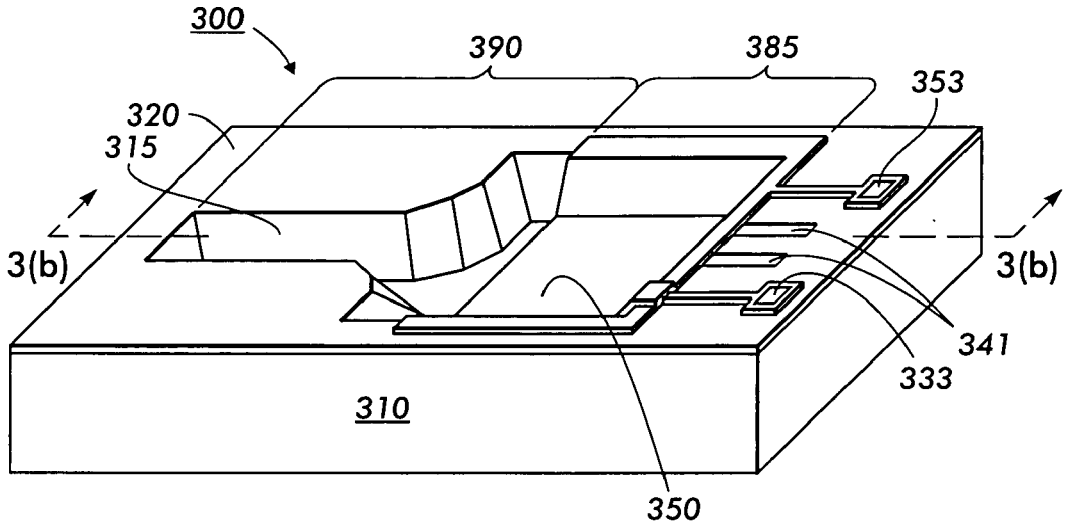
FIG. 3(*a*) is a perspective view of an exemplary fluid ejection device according to this invention.
Figure 3B:
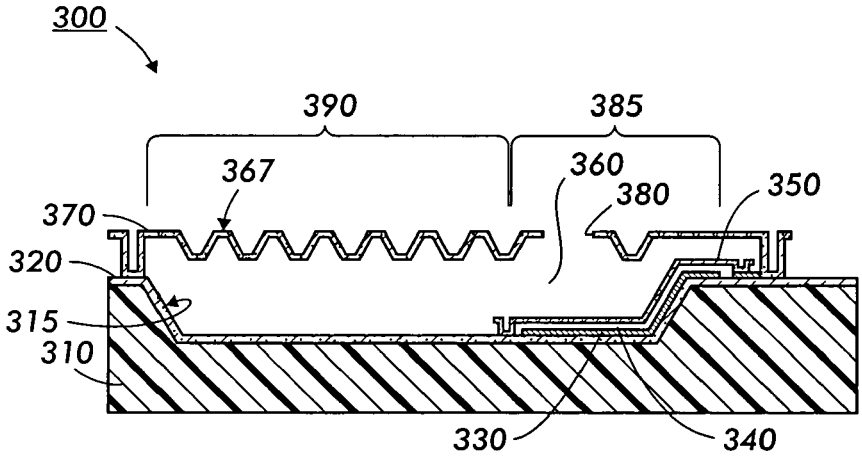

FIG. 3(*a*) is a perspective view of an exemplary fluid ejection device according to this invention, and FIG. 3(*b*) is a cross-section view of that device. The exemplary fluid ejection device 300 shown in FIGS. 3(*a*) and 3(*b*) includes a substrate 310 having a cavity 315 including a fluid ejector section 385 and a microchannel section 390. A dielectric layer 320 is formed over the substrate. As shown in FIG. 3(*a*), the fluid ejector section 385 includes a actuator membrane 350, a bonding pad 353 for the actuator membrane 350 and a bonding pad 333 for the counter electrode (not shown in FIG. 3(*a*)). Additionally, as shown in FIG. 3(*b*), the fluid ejector 300 includes a counter electrode 330, an actuator cavity 340, a fluid cavity 360, a corrugated roof layer 370 including corrugation features 367 and a nozzle 380. The embodiment shown in FIGS. 3(*a*) and 3(*b*) further includes release channels 341, which allow removal of a sacrificial layer formed between the counter electrode 330 and the actuator membrane 350 during manufacture.

As can be seen in FIG. 3(*a*), the cavity 315 formed in the substrate 310 of the fluid ejection device 300 includes a fluid ejector section 385 and a microchannel section 390. The microchannel section 385 is a corridor through which a fluid can be provided from an external source to the fluid ejector section 385. The fluid ejector section 385 is the region of the cavity 315 that functions to eject fluid from the fluid ejection device 300. When an applied voltage is removed from the counter electrode 330 and the actuator membrane 350 is released, fluid situated in the fluid ejection section 385 of the cavity 315 is subjected to pressure and ejected from the fluid ejection device 300 through the nozzle 380.

The fluid ejection device 300 also includes bonding pads 333 and 353 for the counter electrode 330 and the actuator membrane 350, respectively. The bonding pad 333 for the counter electrode 330 permits voltage to be applied to the counter electrode 330. The bonding pad 353 for the actuator membrane 350 permits the actuator membrane 350 to be grounded. As discussed above, the application and removal of voltage to the counter electrode 330 permits the fluid ejection device 300 to eject fluids.

Figure 4A:
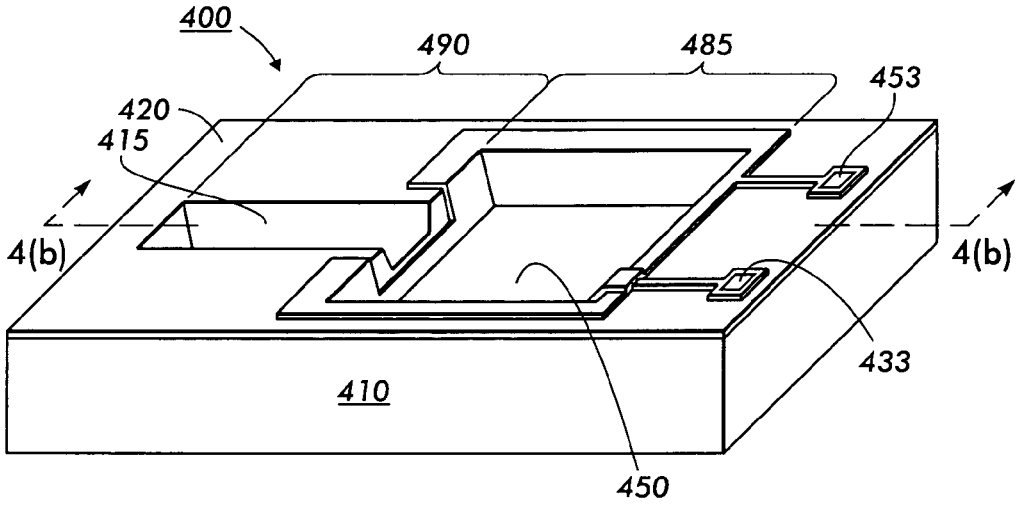
FIG. 4(*a*) is a perspective view of an exemplary fluid ejection device according to this invention.
Figure 4B:
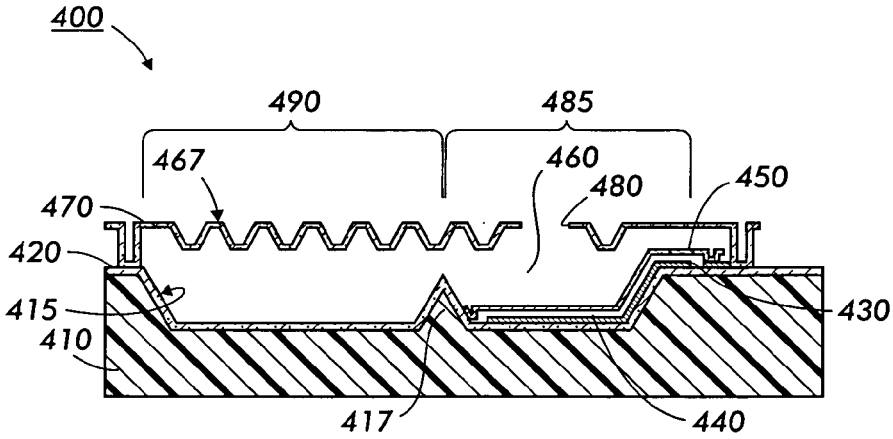

FIG. 4(*a*) is a perspective view of an exemplary fluid ejection device according to this invention, and FIG. 4(*b*) is a cross-section view of that device. The exemplary fluid ejection device 400 shown in FIGS. 4(*a*) and 4(*b*) includes a substrate 410 having a cavity 415 including a fluid ejector section 485 and a microchannel section 490. A dielectric layer 420 is formed over the substrate. A throat section 417 divides the fluid ejector section 485 and the microchannel section 490. As shown in FIG. 4(*a*), the fluid ejector section 485 includes a actuator membrane 450, a bonding pad 453 for the actuator membrane 450 and a bonding pad 433 for the counter electrode (not shown in FIG. 4(*a*)). Additionally, as shown in FIG. 4(*b*), the fluid ejector 400 includes a counter electrode 430, an actuator cavity 440, a fluid cavity 460, a corrugated roof layer 470 including corrugation features 467 and a nozzle 480.

In addition to the features described above with respect to FIGS. 3(*a*) and 3(*b*), the fluid ejection device 400 shown in FIGS. 4(*a*) and 4(*b*) includes a throat section 417. The throat section 417 separates the fluid ejector section 485 and the microchannel section 490. Because the throat section 417 provides a partial barrier between the fluid ejector section 485 and the microchannel section 490, when the actuator membrane 450 is actuated to eject an amount fluid through the nozzle 480, the amount of fluid that is propelled into the microchannel section 490, instead of being ejected out through the nozzle 480 is reduced. This reduction in the amount of fluid that is propelled into the microchannel section 490 results in an improvement in ejection efficiency of the fluid ejection device 400, which is measured as a ratio of the amount of fluid that is ejected to the amount of fluid that is propelled back to a fluid reservoir (not shown) via the microchannel section 485. The minor dimension of the ejector can be from about 80 to about 200 microns. In various exemplary embodiments, microchannel depth can range from about 10 to about 100 microns. In various exemplary embodiments, a throat section will have a depth less than a depth of a microchannel section, and a width less or equal to a width of a microchannel section.

Figure 5A:
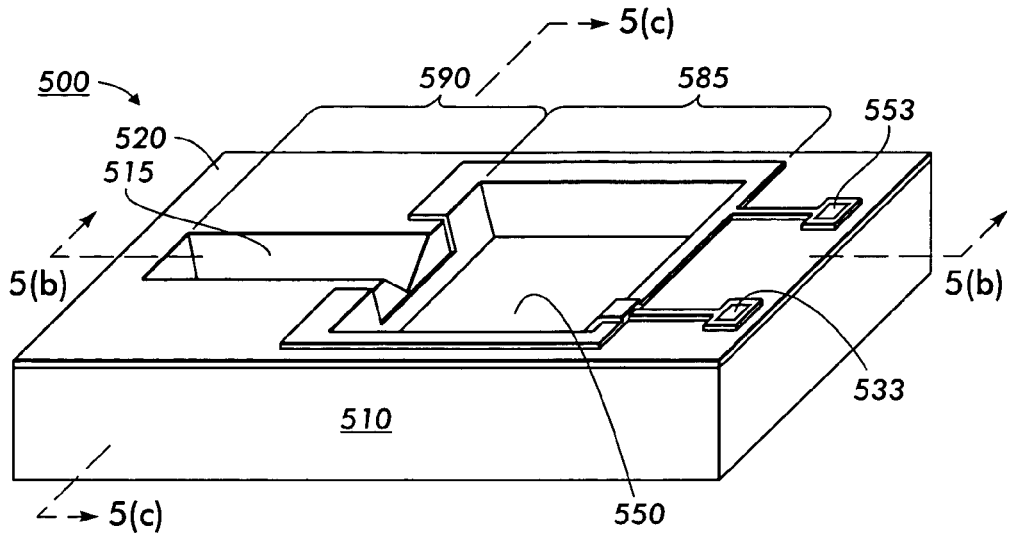
FIG. 5(*a*) is a perspective view of an exemplary fluid ejection device according to this invention.
Figure 5B:
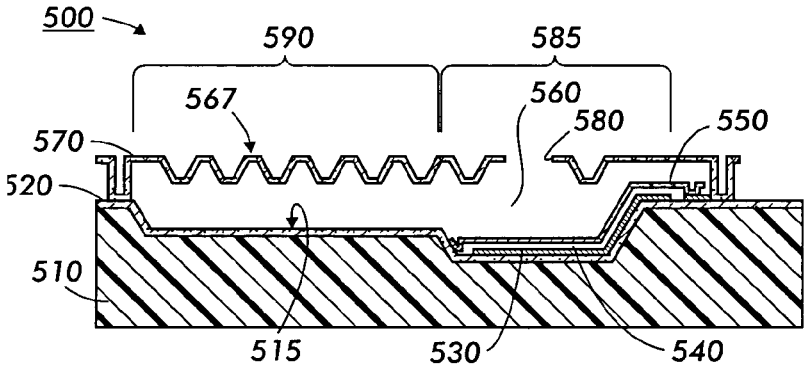
Figure 5C:
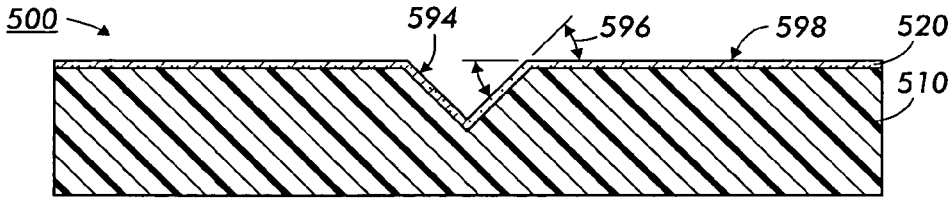

FIG. 5(*a*) is a perspective view of an exemplary fluid ejection device according to this invention, and FIGS. 5(*b*) and 5(*c*) are cross-section views of that device. The exemplary fluid ejection device 500 shown in FIGS. 5(*a*), 5(*b*) and 5(*c*) includes a substrate 510 having a cavity 515 including a fluid ejector section 585 and a microchannel section 590. A dielectric layer 520 is formed over the substrate. As shown in FIG. 5(*a*), the fluid ejector section 585 includes a actuator membrane 550, a bonding pad 553 for the actuator membrane 550 and a bonding pad 533 for the counter electrode (not shown in FIG. 5(*a*)). Additionally, as shown in FIG. 5(*b*), the fluid ejector 500 includes a counter electrode 530, an actuator cavity 540, a fluid cavity 560, a corrugated roof layer 570 including corrugation features 567 and a nozzle 580.

In addition to the features described above, the fluid ejection device 500 shown in FIGS. 5(*a*) and 5(*b*) includes a narrow microchannel section 590. By employing the microchannel section 590, which is both narrower and shallower than the microchannel sections shown in other embodiments, the flow of ink through the section 590 can be restricted. As shown in FIG. 5(*c*), by forming the microchannel section 590 to have a narrow width, the depth of the channel is controlled by the intersection of (111) planes 594 of the substrate 510. In a single-crystal silicon substrate, the angle 596 between the (111) planes 594 defining the microchannel section 590 and the (100) plane 598 of the substrate 510 is 54.74°. It is possible to control the amount of ink flow by varying the width and corresponding depth of the microchannel section 590. In the embodiment shown in FIGS. 5(*a*), 5(*b*) and 5(*c*), the fluid ejector section 585 has different depth than the microchannel section 590. For example, to manufacture a fluid ejector having a cavity depth of 100 microns and a microchannel section depth of 40 microns in a single wet etching process step, a microchannel section width of 56.6 microns is required [2×40/TAN(54.74°)].

Figure 6:
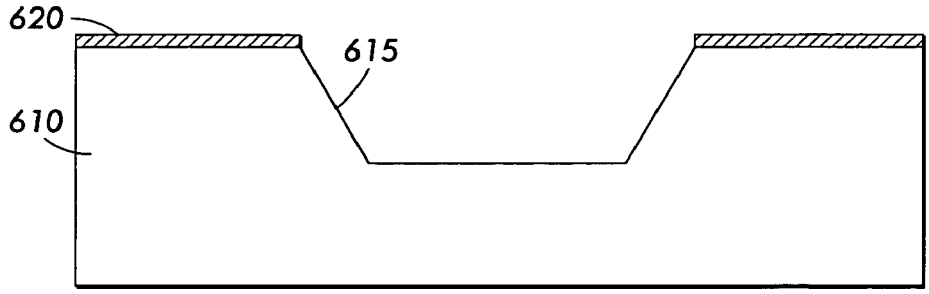
FIGS. 6-13 are cross-section views of a fluid ejection device assembled by an exemplary method of manufacturing a fluid ejection device according to this invention.

FIGS. 6-13 are cross-section views of a fluid ejection device assembled by an exemplary method of manufacturing a fluid ejection device according to this invention. FIG. 6 shows a substrate 610 including a cavity 615, and a dielectric layer 620 formed over the substrate 610. The substrate 610 shown in FIG. 6(*a*) is formed by performing an oxidation process to form an oxide hard-mask layer on the substrate. In various exemplary embodiments, the oxidation process is a thermal oxidation process. The oxide hard-mask layer is then patterned in preparation for formation of the cavity 615. The substrate 610, including the formed oxide layer, is then etched to form the cavity 615. In various exemplary embodiments, the etch is a wet KOH etch. In various exemplary embodiments, the substrate 610 is etched to form a cavity having a depth of from about 10 to about 100 microns. After the etch is complete, the oxide hard-mask layer is removed to provide a structure such as, for example, the structure shown in FIG. 6(*a*).

Figure 7:
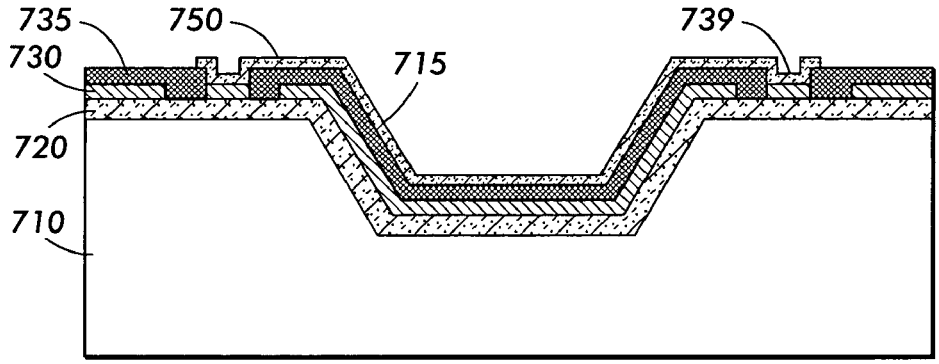

FIG. 7 shows a substrate 710, a cavity 715, a dielectric layer 720, a counter electrode 730, a first sacrificial layer 735 and an actuator membrane 750. After the oxide hard-mask layer is removed, a thin dielectric oxide is grown on the substrate 710. In various exemplary embodiments, the thin dielectric oxide is grown by thermal oxidation. Another insulating layer is then deposited on the substrate 710. In various exemplary embodiments, the insulating layer is a low-stress silicon nitride layer. In various exemplary embodiments, the insulating layer is about 0.2 to about 0.8 microns in thickness. In various exemplary embodiments, the insulating layer is formed by low pressure chemical vapor deposition (LPCVD). The oxide layer and the second insulating layer allow structures formed on the substrate 710 to be electrically isolated from the substrate 710. In various exemplary embodiments, insulating layers are patterned and etched to enable substrate contacts from the front side of a wafer.

After the oxide layer and insulating layer are deposited, the counter electrode 730 is formed. In various exemplary embodiments, the counter electrode 730 is formed by depositing a low stress polysilicon film or amorphous silicon film on the substrate 710. In various exemplary embodiments, the counter electrode 730 is formed by depositing a film having a thickness of about 0.5 microns. In various exemplary embodiments, the counter electrode 730 is formed by depositing a film by LPCVD, doping the film and patterning the film. After the counter electrode 730 is formed on the substrate 710, a first sacrificial layer 735 is formed on the substrate. In various exemplary embodiments, the first sacrificial layer 735 is a phosphosilicate glass (PSG) layer. In various exemplary embodiments, PSG is formed to have a thickness of a few microns. In some such embodiments, PSG is formed to have a thickness of about 1 micron.

After the first sacrificial layer 735 is deposited on the substrate 710, anchor openings 739 are formed in the first sacrificial layer 735. In various exemplary embodiments, the anchor openings 739 are formed by patterning the first sacrificial layer 735 lithographically. After the first sacrificial layer 735 is patterned, anchor openings 739 can be formed by, for example, reactive ion etching (RIE). After anchor openings 739 are formed in the sacrificial layer 735, the actuator membrane 750 is deposited on the substrate 710. In various exemplary embodiments, the actuator membrane 750 is a polysilicon or an amorphous silicon layer. In various exemplary embodiments, the actuator membrane 750 is formed to have a thickness of from about 0.5 to about 5.0 microns. In some such embodiments, the actuator membrane 750 can be formed to a thickness of from about 1 to about 3 microns. After the actuator membrane 750 is formed, it can be doped, annealed, patterned and etched to refine the particular structure of the actuator membrane 750 and electrical contacts thereto.

Figure 8:
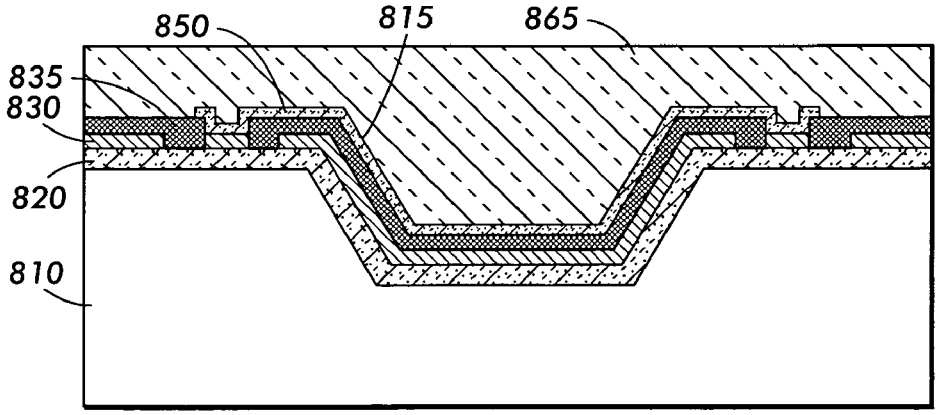

FIG. 8 shows a substrate 810, a dielectric layer 820, a counter electrode 830, a first sacrificial layer 835, a membrane 850 and a second sacrificial layer 865. After the actuator membrane 850 is formed, the second sacrificial layer 865 is formed on the substrate 810. In various exemplary embodiments, the second sacrificial layer 865 is formed on the substrate 810 by a spin-on-glass (SOG) technique.

SOG is conducted by spinning liquid chemicals (e.g., silicates or siloxanes) on to the substrate 810. The applied liquid is solidified by annealing or curing. The thickness of the second sacrificial layer 865 can be accurately controlled by adjusting the spinning speed and the curing conditions. Also, multiple iterations of SOG can be performed to form a thicker second sacrificial layer 865. In various exemplary embodiments, SOG is performed to fill all recessed areas on the substrate 810 after the actuator membrane 850 is formed. In various exemplary embodiments, after all recessed areas on the substrate 810 are filled, the thickness of the second sacrificial layer 865 is increased by from about 6.0 to about 8.0 microns. In various exemplary embodiments, after the second sacrificial layer 865 is formed, it is planarized. In various exemplary embodiments, the second sacrificial layer 865 is planarized by chemical-mechanical polishing (CMP). In various exemplary embodiments, a second sacrificial layer 865 will have a thickness of between about 10 and about 100 microns—that is, a thickness about the same as a desired trench depth.

Figure 9:
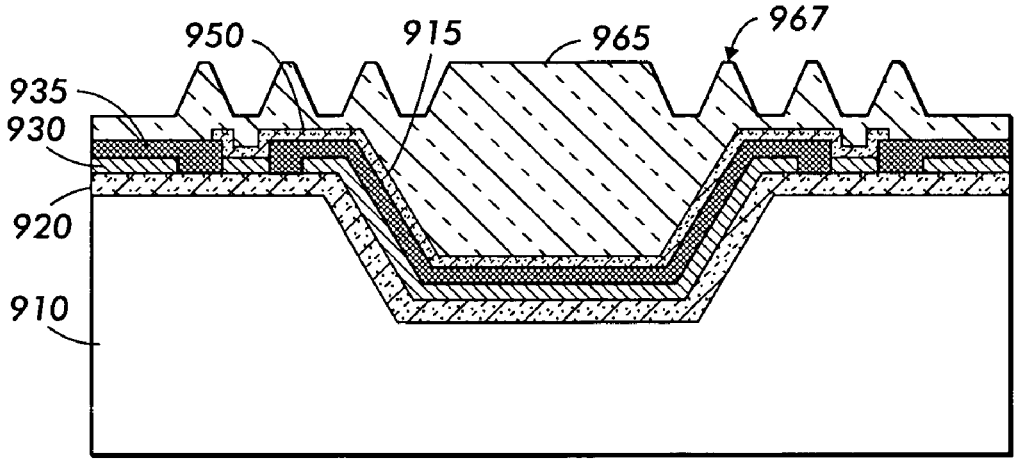

FIG. 9 shows a substrate 910, a dielectric layer 920, a counter electrode 930, a first sacrificial layer 935, an actuator membrane 950 and a second sacrificial layer 965. The second sacrificial layer 965 includes corrugation features 967. After the second sacrificial layer 965 is formed, corrugation features 967 are formed in the second sacrificial layer 965. In various exemplary embodiments, the corrugation features 967 are formed by patterning and etching the sacrificial layer 965. In various exemplary embodiments, the corrugation features 967 are formed by a wet etch. In other exemplary embodiments, the corrugation features 967 are formed by a dry etch. It should be appreciated that a fluid ejection device can be formed by this method without forming the corrugation features 967. Also, while the specification refers to "corrugation" features that are used to form a "corrugated" roof layer, any features may be employed that will enhance the mechanical strength of the roof layer. For example, the corrugation features can include rib structures, instead of corrugations.

Figure 10:
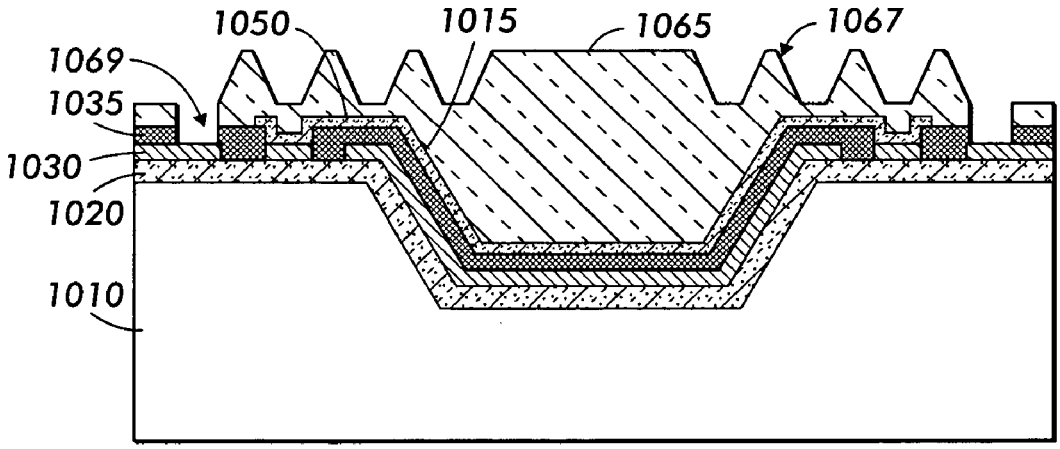

FIG. 10 shows a substrate 1010, a dielectric layer 1020, a counter electrode 1030, a first sacrificial layer 1035, an actuator membrane 1050 and a second sacrificial layer 1065 including corrugation features 1067. Second anchor areas 1069 are formed through the second sacrificial layer 1065 and the first sacrificial layer 1035. In various exemplary embodiments, the anchor areas 1069 are formed by patterning and etching the sacrificial layers 1065 and 1035. In various exemplary embodiments, the anchor areas 1069 are formed by dry etching the second sacrificial layer 1065.

Figure 11:
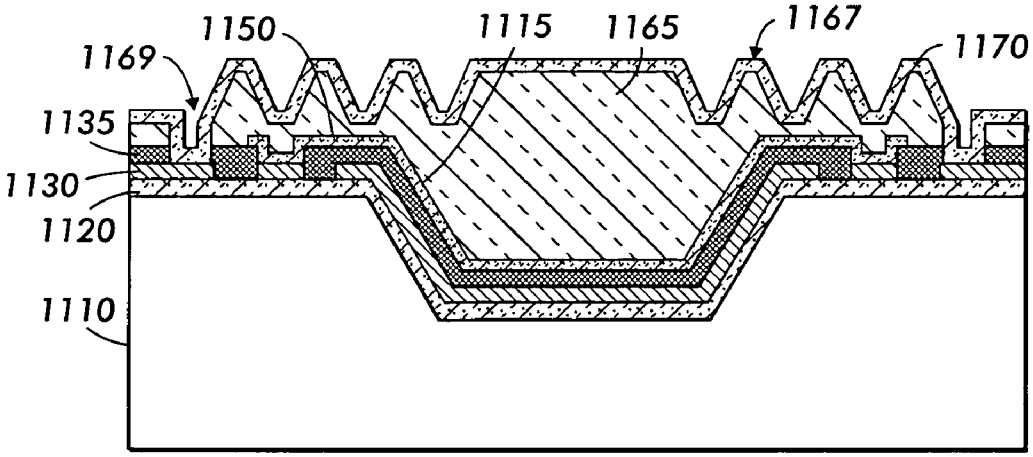

FIG. 11 shows a substrate 1110, a dielectric layer 1120, a counter electrode 1130, a first sacrificial layer 1135, an actuator membrane 1150 and a second sacrificial layer 1165 including corrugation features 1167, as well as anchor areas 1169. A corrugated roof layer 1170 is formed over the sacrificial layer 1165. After the anchor areas 1169 are formed in the second sacrificial layer 1165, the corrugated roof layer 1170 is formed. In various exemplary embodiments, the corrugated roof layer 1170 is formed of polysilicon or amorphous silicon. In various exemplary embodiments, the corrugated roof layer 1170 is formed by LPCVD. In various exemplary embodiments, the corrugated roof layer 1170 formed by LPCVD is annealed. In various exemplary embodiments, the corrugated roof layer 1170 has a thickness of from about 0.5 to about 5 microns. In some such embodiments, the corrugated roof layer 1170 has a thickness of from about 1 to about 3 microns.

Figure 12:
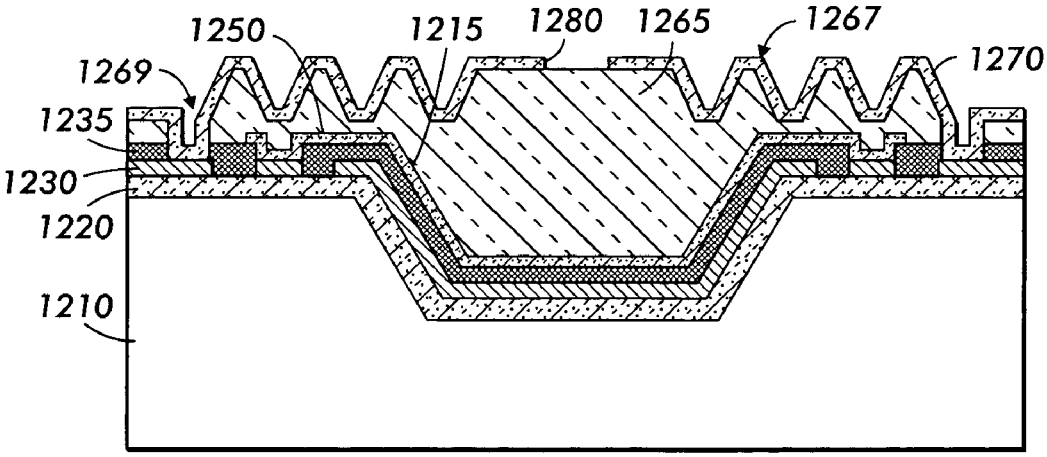

FIG. 12 shows a substrate 1210, a dielectric layer 1220, a counter electrode 1230, a first sacrificial layer 1235, an actuator membrane 1250, a second sacrificial layer 1265 including corrugation features 1267, anchor areas 1269 and a corrugated roof layer 1270 is formed over the second sacrificial layer 1265. After the corrugated roof layer 1270 is formed, a nozzle 1280 is formed in the corrugated roof layer 1270. In various exemplary embodiments, the nozzle 1280 is formed in the corrugated roof layer 1270 by patterning and etching the corrugated roof layer 1270. In various exemplary embodiments, the corrugated roof layer 1270 is etched by RE. In various exemplary embodiments, bonding pads are formed on the substrate 1210 after the nozzle 1280 is formed. In various exemplary embodiments, the nozzle 1280 has a diameter of from about 10 to about 50 microns. In some such embodiments, the nozzle 1280 has a diameter of from about 20 to about 30 microns.

Figure 13:
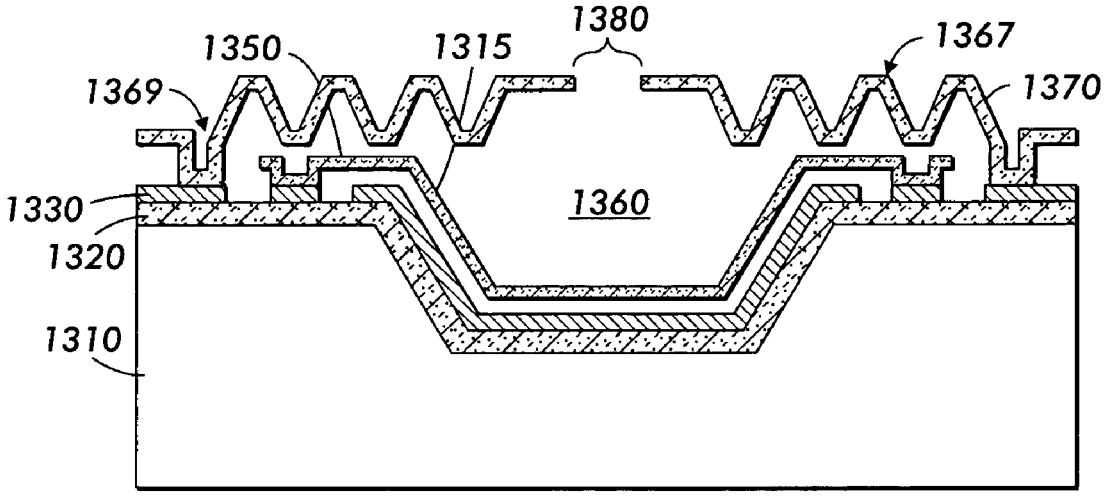

FIG. 13 shows a substrate 1310, a dielectric layer 1320, a counter electrode 1330, an actuator membrane 1350, anchor areas 1369 and corrugated roof layer 1370 including a nozzle 1380. A first sacrificial layer is replaced by an actuator membrane cavity 1340 and a second sacrificial layer is replaced by a fluid cavity 1360. After the nozzle 1380 is formed in the corrugated roof layer 1370, the first sacrificial layer and the second sacrificial layer are removed. In various exemplary embodiments, the first sacrificial layer and the second sacrificial layer are removed by etching. In various exemplary embodiments, the first sacrificial layer and the sacrificial layer are removed by liquid or gas etching. In various exemplary embodiments, the first sacrificial layer and the second sacrificial layer are removed by etching with HF. Removing the first sacrificial layer and the second sacrificial layer leaves a fluid ejection device.

The material forming the first sacrificial layer is released from the fluid ejection device through one or more release channels or holes (see release channels 341 in FIG. 3(*a*)). The release channels or holes can be located inside the fluid cavity 1360. If such release channels or holes are used, in operation, fluid will fill both the fluid cavity 1360 and the actuator membrane cavity 1340. Alternatively, the release channels or holes can be extended outside the fluid cavity 1360 (See FIG. 3(*a*)). With such a configuration, fluid is prevented from entering the actuator membrane cavity 1340.

Figure 14:
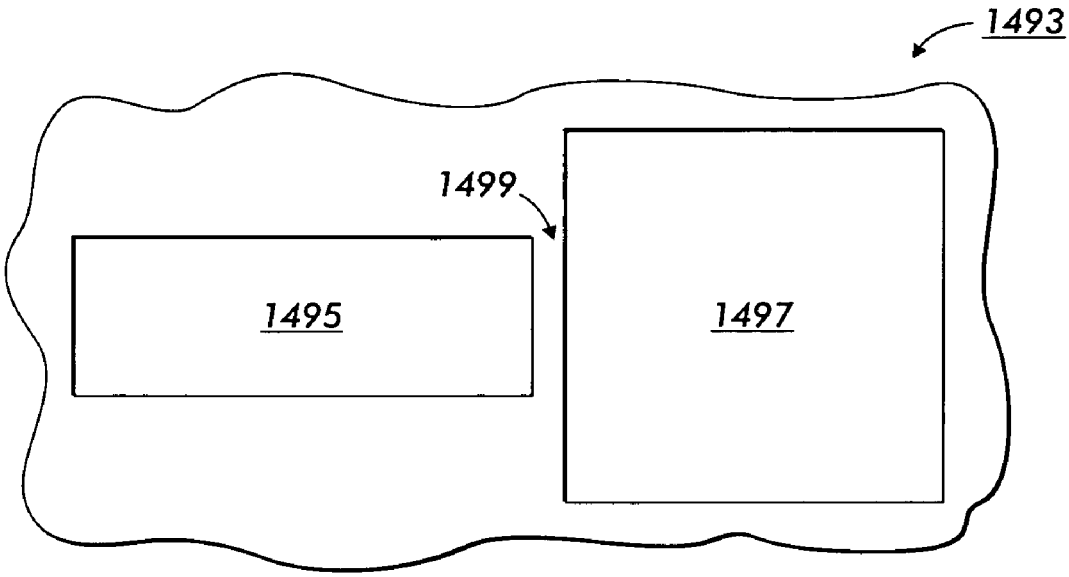
FIG. 14 is a schematic view of an exemplary mask according to this invention.

FIG. 14 is a schematic view of an exemplary mask according to this invention. The exemplary mask 1493 includes a microchannel feature 1495 and a fluid ejector feature 1497. The microchannel feature 1495 and the fluid ejector feature 1497 are divided by a gap 1499. As discussed above, for example with respect to FIGS. 4(*a*) and 4(*b*), forming a throat section 417 provides a partial barrier between the fluid ejector section 485 and the microchannel section 490, when the actuator membrane 450 is actuated to eject an amount fluid through the nozzle 480, the amount of fluid that is propelled into the microchannel section 490, instead of being ejected out through the nozzle 480 is reduced. This reduction in the amount of fluid that is propelled into the microchannel section 490 results in an improvement in ejection efficiency of the fluid ejection device 400, which is measured as a ratio of the amount of fluid that is ejected to the amount of fluid that is propelled back to a fluid reservoir (not shown) via the microchannel section 490. By using the mask 1493 shown in FIG. 14 to form a cavity in a substrate, it is possible to form a cavity having a fluid ejector section, a microchannel section, and a throat section partially separating the two.

While this invention has been described in conjunction with the exemplary embodiments and examples outlined above, various alternatives, modifications, variations, improvements and/or substantial equivalents, whether known, presently unforeseen or that may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. A fluid ejection device, comprising:

a substrate having a cavity with a depth of from about 10 to about 100 microns;

a dielectric layer formed on the substrate;

a counter electrode formed on the dielectric layer, the counter electrode being situated at least in part in the cavity;

a actuator membrane formed on the substrate, the actuator membrane being situated so as to substantially encapsulate the counter electrode;

a roof layer formed on the substrate, the roof layer being situated so as to cover the cavity; and a nozzle formed in the roof layer.

2. The fluid ejection device of claim 1, wherein the substrate is a silicon substrate with an insulating layer formed thereon.

3. The fluid ejection device of claim 1, wherein the cavity is formed with a throat structure partially separating the cavity into a microchannel portion and a fluid ejector portion.

4. The fluid ejection device of claim 3, wherein the substrate is a silicon substrate, the microchannel portion has a cross-section area restricted by a width of the microchannel portion and an orientation of (111) crystallographic planes of the silicon substrate.

5. The fluid ejection device of claim 1, wherein the counter electrode is a polysilicon counter electrode.

6. The fluid ejection device of claim 1, wherein the actuator membrane is formed of at least one material selected from the group consisting of polysilicon and amorphous silicon.

7. The fluid ejection device of claim 1, wherein an actuator cavity is situated between the counter electrode and the actuator membrane.

8. The fluid ejection device of claim 1, wherein the roof layer is formed from a material selected from the group consisting of polysilicon and amorphous silicon.

9. The fluid ejection device of claim 1, wherein the roof layer includes a plurality of corrugation features.

10. A method for forming a fluid ejection device, comprising:

forming a cavity in a substrate, the cavity having a depth of from about 10 to about 100 microns;

forming a dielectric layer on the substrate, forming a counter electrode on the dielectric layer, at least a portion of the counter electrode being formed in the cavity;

forming an actuator membrane on the substrate, the actuator membrane being formed so as to encapsulate the counter electrode;

forming a roof layer on the substrate, the roof layer being formed so as to cover the cavity; and forming a nozzle in the roof layer.

11. The method of claim 10, wherein forming a cavity comprises:

forming an oxide or nitride hard-mask layer on a silicon substrate;

patterning the oxide or nitride hard-mask layer; and etching the patterned oxide or nitride layer and the silicon substrate.

12. The method of claim 10, further comprising wherein forming a counter electrode comprises:

forming a counter electrode layer on the dielectric layer;

doping the counter electrode layer; and patterning and etching the counter electrode layer to form the counter electrode.

13. The method of claim 10, wherein forming a actuator membrane comprises:

forming a first sacrificial layer over the counter electrode on the substrate;

etching the first sacrificial layer to form anchor openings;

forming actuator membrane layer over the first sacrificial layer;

doping the actuator membrane layer; and patterning and etching the actuator membrane layer to form the moveable membrane.

14. The method of claim 13, wherein forming a first sacrificial layer comprises forming a phosphosilicate glass layer.

15. The method of claim 13, wherein forming a actuator membrane layer comprises forming a polysilicon actuator membrane layer by low pressure chemical vapor deposition.

16. The method of claim 10, wherein forming a roof layer comprises:

forming a second sacrificial layer over the actuator membrane;

patterning and etching the second sacrificial layer; and forming a roof layer over the second sacrificial layer.

17. The method of claim 16, wherein forming a second sacrificial layer comprises performing a spin-on-glass technique.

18. The method of claim 16, wherein forming a roof layer comprises forming a polysilicon roof layer by low pressure chemical vapor deposition.

19. The method of claim 10, wherein forming a nozzle comprises patterning and etching the roof layer.

* * * * *